US007458858B2

(12) United States Patent
Kuo

(10) Patent No.: US 7,458,858 B2
(45) Date of Patent: Dec. 2, 2008

(54) ELECTRICAL CONNECTOR

(75) Inventor: Peter Kuo, Tu-cheng (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 11/893,290

(22) Filed: Aug. 15, 2007

(65) Prior Publication Data

US 2008/0045082 A1 Feb. 21, 2008

(30) Foreign Application Priority Data

Aug. 15, 2006 (CN) ..... 2006 2 0077101

(51) Int. Cl.
*H01R 24/00* (2006.01)

(52) U.S. Cl. ..... 439/675

(58) Field of Classification Search ..... 439/578, 439/675, 905, 750, 598, 599
See application file for complete search history.

(56) References Cited

U.S. PATENT DOCUMENTS 5,529,522 A 6/1996 Huang
5,662,489 A 9/1997 Stirling
6,203,370 B1 3/2001 Lee
6,729,911 B1 * 5/2004 Hu ..... 439/675
7,294,023 B2 * 11/2007 Schneider ..... 439/675
7,329,139 B2 * 2/2008 Benham ..... 439/352
2006/0030208 A1 * 2/2006 Cassanego et al. ..... 439/578
2006/0292925 A1 * 12/2006 Chawgo ..... 439/578

* cited by examiner

*Primary Examiner*—Phuong K Dinh
(74) *Attorney, Agent, or Firm*—Wei Te Chung

(57) ABSTRACT

An electrical connector (100) includes a connector body (1), a shell (2), a ring (3) and a cable wire (5). The connector body forms at least one pin (11), an exterior surface (12) defining a first diameter and an connecting portion (13), whose outer diameter is smaller than the first diameter. The shell forms a mating portion (23) and a covering portion (24). The covering portion has an outer diameter larger than that of the mating portion. The ring is sandwiched by the connector body and the shell. An annular rib (27) is formed on the inner side of the mating portion which mates with an annular slot (14) formed on the connecting portion.

3 Claims, 4 Drawing Sheets

ELECTRICAL CONNECTOR

BACKGROUND OF THE INVENTION

1. Field of the Invention

The present invention relates generally to an electrical connector, and particularly to such an electrical connector easy to be assembled.

2. Description of Related Arts

RCA connectors are often found in video and audio recording, storage, transcription, and play-back equipment. Prior art shown as U.S. Pat. No. 6,203,370, issued on Mar. 20, 2001, has disclosed an electrical connector. The electrical connector comprises a connector body, a shell and an O-ring compressed between the connector body and the shell. At least one pin is formed at a first end of the connector body, and the pin is electrically insulated from the connector body. The connector body forms an exterior surface of the first end defining a first diameter and an outside threaded portion having an outer diameter less than the first diameter. Accordingly, a shoulder is formed between the exterior surface and the threaded portion. The shell comprises an inside threaded end having an edge for threadably engaging with the outside threaded portion of the connector body. So, the O-ring is compressed between the shoulder of the connector body and the edge of the shell when the shell is screwed onto the threaded portion, thus, the O-ring thereby provides increased friction between the connector body and the shell for resisting unscrewing forces. However, the shell and the connector body are combined by the threaded portion of the connector body and the threads of the shell screwing with each other. The threads complicate the manufacturing process and the cost of the electrical connector, and furthermore, screwing the small shell onto the small connector body is not easy.

Hence, an electrical connector made by an improved assembling method is desired.

SUMMARY OF THE INVENTION

Accordingly, an object of the present invention is to provide an improved electrical connector.

To achieve the above object, an electrical connector includes a connector body, a shell, a ring and a cable wire. The connector body forms at least one pin, an exterior surface defining a first diameter and an connecting portion, whose outer diameter is smaller than the first diameter. The shell forms a mating portion and a covering portion. The covering portion has an outer diameter larger than that of the mating portion. The ring is sandwiched by the connector body and the shell. An annular rib is formed on the inner side of the mating portion which mates with an annular slot formed on the connecting portion.

Other objects, advantages and novel features of the invention will become more apparent from the following detailed description when taken in conjunction with the accompanying drawings.

DETAILED DESCRIPTION OF THE PREFERRED EMBODIMENT

Figure 1:
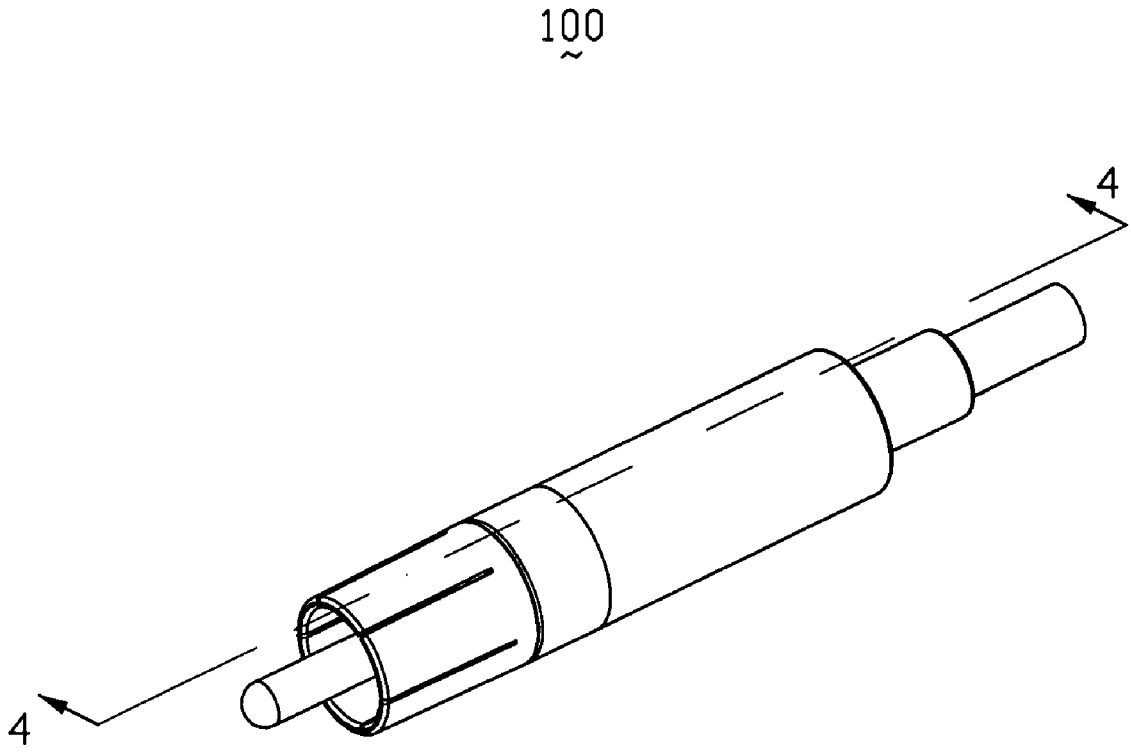
FIG. 1 is a perspective, assembled view of an electrical connector in accordance with the present invention.
Figure 2:
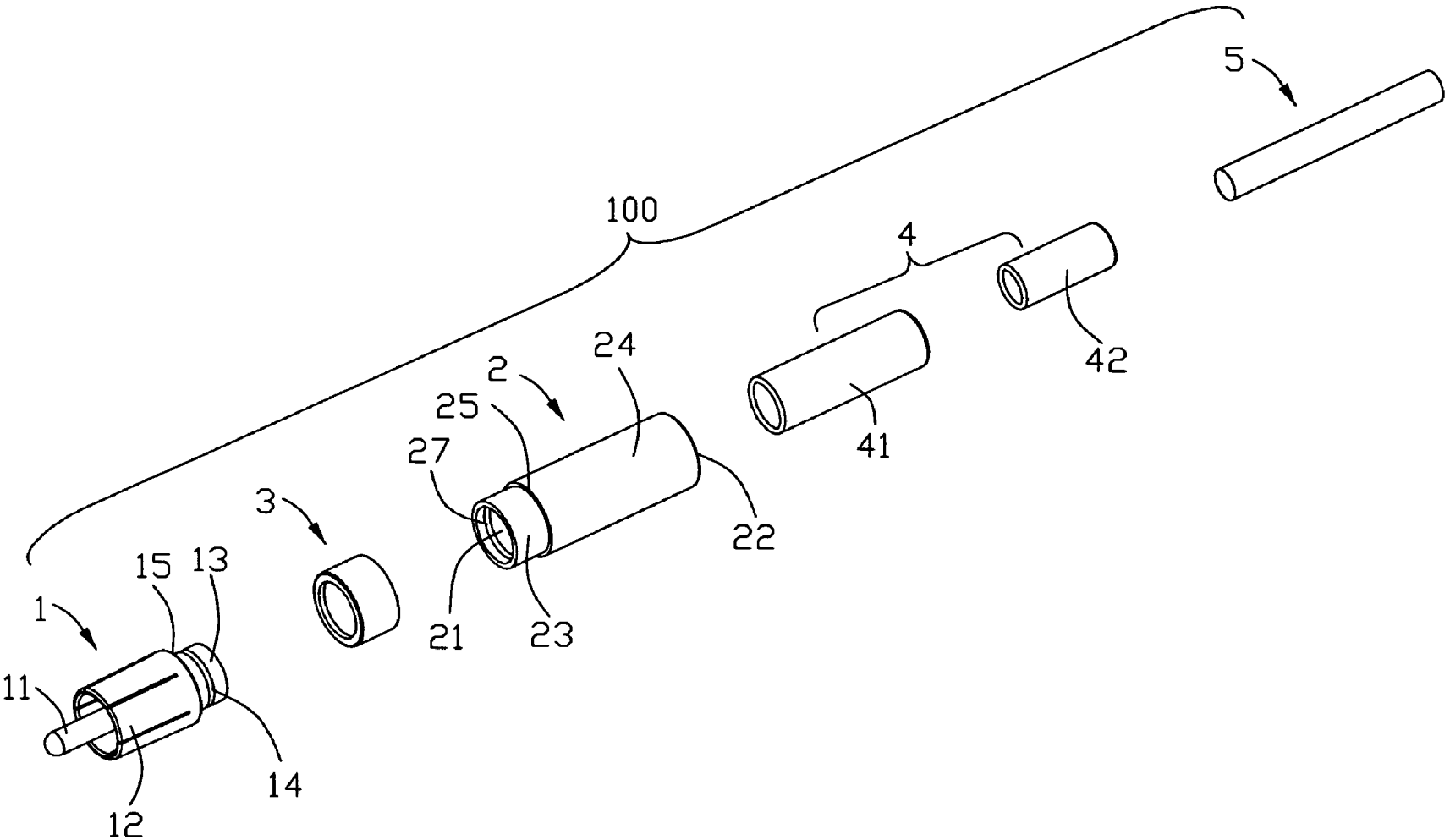
FIG. 2 is a perspective, exploded view of the electrical connector.
Figure 3:
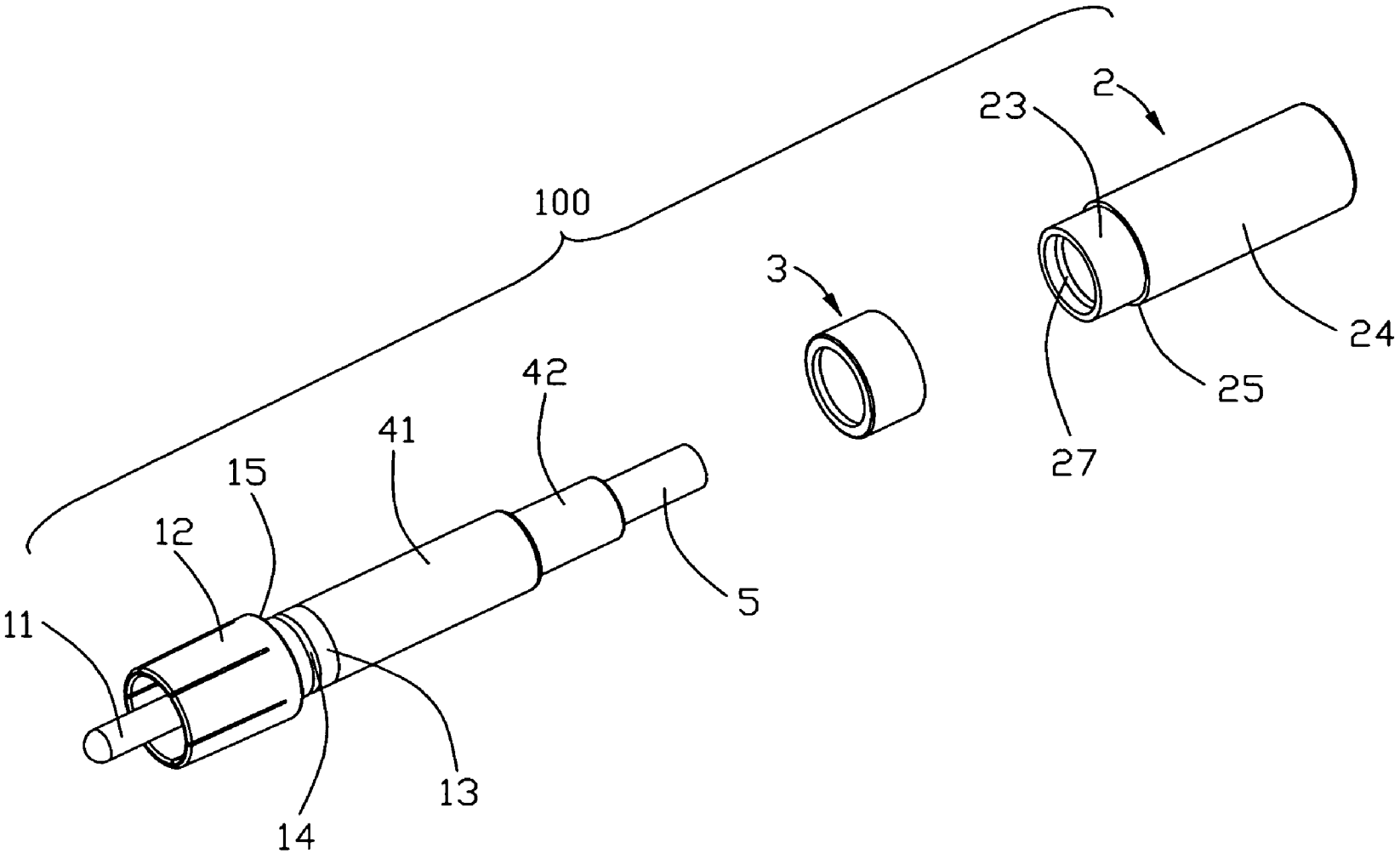
FIG. 3 is a perspective, partially exploded view of the electrical connector.

Referring to FIGS. 1-4, an electrical connector 100 comprises a connector body 1, a shell 2, a ring 3, a strain relief 4 and a cable wire 5. In a preferred embodiment of the invention, the electrical connector 100 is an RCA connector. The connector body 1 comprises a pin 11 on a plug side of the connector body 1, a cylindrical outer sleeve 12 surrounding the pin 11 and a cylindrical connecting portion 13. The pin 11 is insulated from the outer sleeve 12 and the connecting portion 13 due to insulative material (not labeled) therebetween. The connecting portion 13 of the connector body 1 has a smaller outer diameter than that of the outer sleeve 12, accordingly, a first shoulder 15 is formed therebetween, as shown. Furthermore, an annular narrow slot 14 is defined at and around the connecting portion 13.

Figure 4:
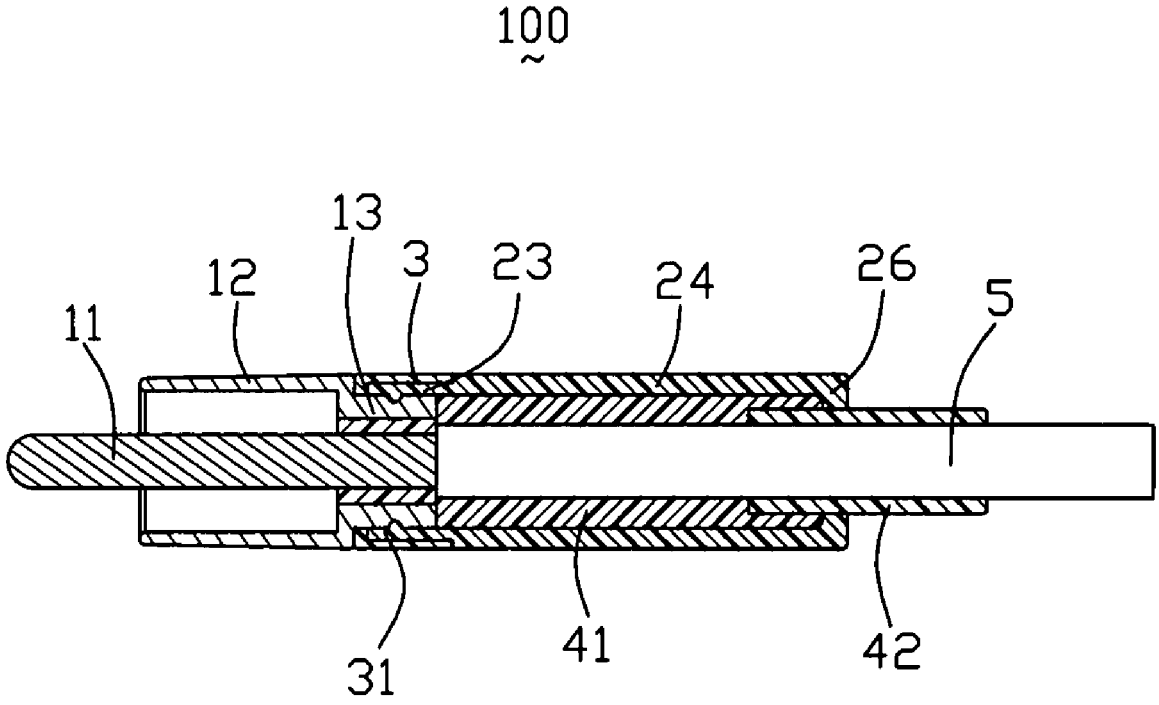
FIG. 4 is a cross-section view of the electrical connector taken along line 4-4 shown in FIG. 1.

The shell 2, defining a first end 21 and a second end 22, has a cylindrical mating portion 23 and a cylindrical covering portion 24. The outer diameter of the mating portion 23 is smaller than that of the covering portion 24, so, a second shoulder 25 is formed between the mating portion 23 and the covering portion 24. At the second end 22, the outer surface of the covering portion 24 extends inwardly to form a hook 26, as shown in FIG. 4 and the inner diameter of the first end 21 is larger than that of the second end 22. An annular rib 27 is formed on the inner side of the mating portion 23 for engaging with the annular narrow slot 14. In the preferred embodiment, the shell 2 is made of a translucent and insulative material such as hard plastic.

The ring 3 is made of an insulative material such as hard plastic. In the preferred embodiment, the inner diameter of the ring 3 is larger than the outer diameter of the connecting portion 13, but is smaller than the outer diameter of the outer sleeve 12, and the inner diameter of the ring 3 is slightly larger than the outer diameter of the mating portion 23, but is smaller than the outer diameter of the covering portion 24. Furthermore, the outer diameter of the ring 3 is approximately equal to that of the outer sleeve 12 and that of the covering portion 24. In the preferred embodiment, the ring 3 is made of colorful material so as to identify the cable wire 5.

The strain relief 4 comprises a first strain relief 41 and a second strain relief 42, both shaped as cylinders. The second strain relief 42 is preformed and partially receiving the cable wire 5. The first strain relief 41 is partially molded over the second strain relief 42.

The cable wire 5 is formed by an insulator surrounding a conductor (not shown).

The conductor of the cable wire 5 is electrically contacted with the pin 11, and the second strain relief 42 partially shields over the cable wire 5, and then the first strain relief 41 partially molds over the second strain relief 42 with one end thereof contacting with the connecting portion 13. The ring 3 shields over the connecting portion 13 of the connector body 1, and because the inner diameter of the ring 3 is larger than the outer diameter of the connecting portion 13, an interspace 31 is created for receiving the mating portion 23. The annular rib 27 of the mating portion 23 is first placed near the annular narrow slot 14 of the connecting portion 13, and then is locked in the annular narrow slot 14 under an external force, so that the mating portion 23 of the shell 2 can be tightly assembled onto the connecting portion 13 of the connector body 1. As the shell 2 is fastened on the connector body 1, the ring 3 is sandwiched by the first shoulder 15 of the connector body 1 and the second shoulder 25 of the shell 2 to provide a more reliable connection for the electrical connector 100. And, the other one end of the first strain relief 41 confronts the hook 26 of the shell 2, i.e., the first strain relief 41 is fully received in the shell 2.

The invention adopts the cooperation of the annular narrow slot 14 of the connecting portion 13 and the annular rib 27 of the mating portion 23 instead of the cooperation of the threaded portion of the connector body and the threads of the shell shown in prior art, so, the assembling method is easy and avoids wrongly assembling. Furthermore, the electrical connector 100 comprises a ring 3 providing a frictional force between the connector body 1 and the shell 2, so, the connection between the connector body 1 and the shell 2 is more reliable.

While a preferred embodiment in accordance with the present invention has been shown and described, equivalent modifications and changes known to persons skilled in the art according to the spirit of the present invention are considered within the scope of the present invention as described in the appended claims.

I claim:

1. An electrical connector, comprising:

a connector body having a pin, an exterior surface defining a first diameter, and a connecting portion having an outer diameter smaller than the first diameter, the connecting portion defining an annular slot around an outer surface thereof;

a shell having a mating portion and a covering portion, the covering portion having an outer diameter larger than that of the mating portion, the mating portion having an annular rib on an inner side thereof;

a ring sandwiched by the connector body and the shell; and a cable wire formed by an insulator surrounding a conductor and electrically connected with the pin;

wherein the annular rib is locked in the annular slot and the ring acts to retain the locked condition of the rib and slot, wherein the ring shields over the mating portion of the shell, wherein the inner diameter of the ring is larger than the outer diameter of the connecting portion, wherein the ring is made of colorful material, and further comprising a second strain relief partially receiving the cable wire and a first strain relief partially molding over the second strain relief, wherein one end of the first strain relief contacts with the connecting portion of the connector body, wherein the covering portion comprises an inwardly extending hook at a free end thereof, wherein the other one end of the first strain relief confronts the hook, wherein the shell is made of translucent material.

2. An electrical connector comprising:

a connector body defining a large mating sleeve enclosing a pin therein with a first exterior diameter, and a small connection section adjoined behind said mating port with a second exterior diameter smaller than the first exterior diameter;

a shell attached to a rear portion of the connector body and defining a large rear covering portion with a third exterior diameter and a small front mating portion with a fourth exterior diameter joined together with each other;

the small front mating portion surrounding the connection section;

a ring surrounding the small front mating portion to cooperate with the connection section for radially sandwiching the small front mating portion therebetween; wherein an interface between an outer circumferential surface of the connection section and an inner circumferential surface defines a circumferential rib formed on one of said outer circumferential surface and said inner circumferential surface, and a circumferential slot formed on the other of said outer circumferential surface and said inner circumferential surface and the ring serves to retain a locked condition of the rib and slot, wherein said ring is essentially axially sandwiched between the mating sleeve and the covering portion, wherein said ring defines a fifth exterior diameter which is similar to both said first exterior diameter and said third exterior diameter, wherein said ring includes a flange at a front end so as to axially abut against the mating portion, wherein at least one of said rib and said slot extends circumferentially completely, wherein the rib is formed on the inner circumferential surface and the slot is formed in the outer circumferential surface.

3. An electrical connector comprising:

a connector body defining a large mating sleeve enclosing a pin therein with a first exterior diameter, and a small connection section adjoined behind said mating port with a second exterior diameter smaller than the first exterior diameter;

a shell attached to a rear portion of the connector body and defining a large rear covering portion with a third exterior diameter and a small front mating portion with a fourth exterior diameter joined together with each other;

one of the small front mating portion and the connection section surrounding the other;

a ring surrounding the small front mating portion to cooperate with the connection section for radially sandwiching the small front mating portion therebetween; wherein an interface between an outer circumferential surface of the connection section and an inner circumferential surface defines a circumferential rib formed on one of said outer circumferential surface and said inner circumferential surface, and a circumferential slot formed on the other of said outer circumferential surface and said inner circumferential surface and the ring serves to retain a locked condition of the rib and slot, wherein said ring is essentially axially sandwiched between the mating sleeve and the covering portion, wherein said ring defines a fifth exterior diameter which is similar to both said first exterior diameter and said third exterior diameter, wherein said ring includes a flange at a front end so as to axially abut against the mating portion, wherein the rib is formed on the inner circumferential surface and the slot is formed in the outer circumferential surface.

* * * * *